US005118128A

United States Patent [19]

Piegay et al.

[11] Patent Number: 5,118,128

[45] Date of Patent: Jun. 2, 1992

[54] SYSTEM FOR MOUNTING A SKI BINDING ON A SKI

[75] Inventors: Yves Piegay, Voiron; Roger Colussi, Rives Sur Fure, both of France

[73] Assignee: Societe Anonyme Skis, Voiron, France

[21] Appl. No.: 335,800

[22] Filed: Apr. 10, 1989

[30] Foreign Application Priority Data

Apr. 12, 1988 [FR] France ..... 88 05252

[51] Int. Cl.[5] ..... A63C 9/08; A63C 9/22

[52] U.S. Cl. ..... 280/633; 280/613

[58] Field of Search ..... 280/613, 633, 634, 620, 280/630, 631, 636

[56] References Cited

U.S. PATENT DOCUMENTS

| | | | |
|---|---|---|---|
| 3,921,997 | 11/1975 | Begey et al. | 280/633 X |
| 3,934,893 | 1/1976 | Greenleaf | 280/633 X |
| 4,141,570 | 2/1979 | Sudmeier | 280/633 X |
| 4,629,210 | 12/1986 | Boussemart et al. | 280/634 |

FOREIGN PATENT DOCUMENTS

| | | | |
|---|---|---|---|
| 2035803 | 1/1972 | Fed. Rep. of Germany | 280/633 |
| 3540428 | 11/1986 | Fed. Rep. of Germany | 280/633 |
| 1217631 | 5/1960 | France | 280/633 |
| 1307982 | 9/1962 | France | 280/633 |
| 1464104 | 11/1966 | France | 280/633 |

*Primary Examiner*—Andres Kashnikow
*Assistant Examiner*—Brian L. Johnson
*Attorney, Agent, or Firm*—Herbert Dubno; Andrew Wilford

[57] ABSTRACT

A mount is used in combination with a ski having a longitudinally extending upper surface, a ski boot, and at least one clamp for securing the boot to the upper surface. The mount comprises an element fixed to the ski, an element fixed to the clamp, and an adjustment mechanism interconnecting the elements for relative stepless displacement transversely of the ski and for fixing them relative to each other against relative movement. When the boot is held by individual toe and heel clamps, each of these clamps is associated with respective such elements and adjustment mechanism. The mechanism normally includes at least one micrometric screw and at least one rack meshing with the screw. The system can also allow the boot to pivot about an axis perpendicular to the upper ski surface relative to the ski.

14 Claims, 3 Drawing Sheets

SYSTEM FOR MOUNTING A SKI BINDING ON A SKI

FIELD OF THE INVENTION

The present invention relates to a ski binding. More particularly this invention concerns an arrangement for mounting a ski binding on a ski.

BACKGROUND OF THE INVENTION

It is standard to secure a ski boot to a ski by means of one or more clamps that allow the boot to be pulled from the ski either when the user wants to remove the skis or in an accident to prevent injury to the user. In a standard system separate toe and heel clamps are used, each provided with a hydraulic and/or spring-loaded release mechanism.

French patent 7,303,036 of Salomon describes such an arrangement wherein the base parts of these clamps, that is the parts that do not move on the ski, are displaceable longitudinally of the ski. Thus it is not only possible to adjust the spacing between the clamps to accommodate boots of different sizes, but it is also possible to center the boot on locations fore or aft of the normal central location, in order to vary the performance of the ski.

Another system described in U.S. Pat. No. 4,141,570 supports the boot clamps on a plate that can be moved along three orthogonal axes extending longitudinally of the ski, transversely of the ski and perpendicular to its upper surface, and transversely of the ski and parallel to its upper surface. Such a system is a refinement on the arrangement allowing the boot to be moved longitudinally and is useful for adapting the bindings to different skiers.

At best such arrangements have the disadvantage that they cannot allow the binding to be fitted to the particular skier as well as to the type of ski being used, the type of snow being skied on, and the type of skiing.

More particularly a ski has a pair of edges typically formed by metal strips that are intended to bite into the snow. The shape of these edges determines the width of the ski at the tip or shovel, at the boot, and at the rear end. These shapes determine the stiffness of the ski along its length, how the ski reacts with the snow, and, in general, the overall performance of the ski. For instance when the ski is relatively narrow at the boot it is possible for the user to put more effort to work at the edges.

Thus for a normal amount of work the transverse lever arm formed by the ski is smallest when the ski is narrow at the boot. As a result it is easier for the skier to angle the ski and the ski is more lively and sensitive. On the other hand a ski that is wide at the boot will grip the snow better at its front end and, due to its curved edges, will tend to cut into the snow. Since the center of the tangential pressures is further forward the ski has a tendency to stay on drag at its rear end. As a result snowplow-type turns are easy while parallel turns are more difficult.

In French patent 954,679 a ski has edges formed as symmetrical circular arcs while in French patent 8,502,048 they are arcs, but not arranged symmetrically with respect to the ski centerline. French patent 8,113,302 has edges that diverge rearward and Austrian patent 372,860 describes ski edges that are wholly asymmetrical from the front end to the rear end of the ski. U.S. Pat. Nos. 4,688,821 and 4,700,967 describe skis where the inner edge has a relatively small radius of curvature whereas the outer edge is substantially straight so that the boot must be mounted offcenter.

Clearly no one system is capable of securing the boot of a specific skier in just the right position, taking into account his or her particular abilities, the characteristics of the skis, the type of skiing, and the type of snow. And nothing now known allows the set position of the binding to be changed without removing the ski and working on it in a shop.

OBJECTS OF THE INVENTION

It is therefore an object of the present invention to provide an improved system for mounting a ski binding on a ski.

Another object is the provision of such an improved system for mounting a ski binding on a ski which overcomes the above-given disadvantages, that is which allows a ski boot to be attached to an ideal location on a given ski.

A further object is to provide such a mount that even allows the position of the ski boot to be changed when skiing conditions or the like change.

SUMMARY OF THE INVENTION

The instant invention is a mount used in combination with a ski having a longitudinally extending upper surface, a ski boot, and at least one clamp for securing the boot to the upper surface. The mount comprises an element fixed to the ski, an element fixed to the clamp, and an adjustment mechanism interconnecting the elements for relative stepless displacement transversely of the ski and for fixing them relative to each other against relative movement.

Thus with the system of this invention it is possible for the skier to adjust the position of his or her ski binding in accordance with his or her own abilities, the type of snow, the type of skiing, the skis being used, and any other current condition. It is even possible, right on the slope, for the skier to stop and change the adjustment if necessary or desired. To improve the liveliness of the ski and its hold on ice, it is possible to move the boot toward the inner edge since it is this inner edge that grabs in a turn. Setting the boot at an angle allows one to change the effect of any flare of the ski in order to influence its maneuverability and in order to accommodate the physiology of the actual skier.

When according to this invention the boot is held by individual toe and heel clamps, each of these clamps is associated with respective such elements and adjustment mechanisms. The mechanisms each normally include at least one micrometric screw and at least one rack meshing with the screw. The elements can be provided with adjacent indicia indicating their relative positions.

Normally in accordance with the invention the ski element is a plate fixed generally centrally on the ski and the ski element is formed with at least one guide surface extending generally perpendicular of the longitudinal axis or centerline of the ski and the clamp element is a slide carried on the ski element and slidable along the guide surface thereof. Furthermore the mechanism includes a screw extending generally perpendicular of the ski, fixed transversely in one of the elements, and threadedly engaging the other element. Thus rotation of the screw relatively transversely displaces the elements.

When the clamp is a heel clamp provided with a guide rail normally fixed on the ski, a clamp member displaceable longitudinally along the rail and engageable with the ski boot, and a screw for relatively longitudinally displacing the member and the rail, the ski element is secured to the rail. Furthermore the mechanism includes a screw extending generally perpendicular of the ski, fixed transversely in one of the elements, and threadedly engaging the other element so that rotation of the screw relatively transversely displaces the elements. In addition in such an arrangement the rail has an abutment and the ski element and the abutment are formed with an interfitting ridge and groove extending transversely of the ski. Such an arrangement can have the ski element and abutment formed with mutually vertically confronting and rearwardly open cutouts. The screw engaged between the member and rail is then exposed at the cutouts and the cutout of the ski element is transversely wider than that of the abutment.

In accordance with a further feature of this invention the boot element is provided with a central downwardly projecting pin and the mechanism includes a screw fixed in the ski element and operatively engaged with the pin. The mechanism is engaged between the pin and the ski element both to displace the pin transversely of the ski and to rotate the pin about an axis perpendicular to the upper surface of the ski. The pin is toothed and the mechanism includes a worm meshing with the teeth of the pin and extending tangentially thereof.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
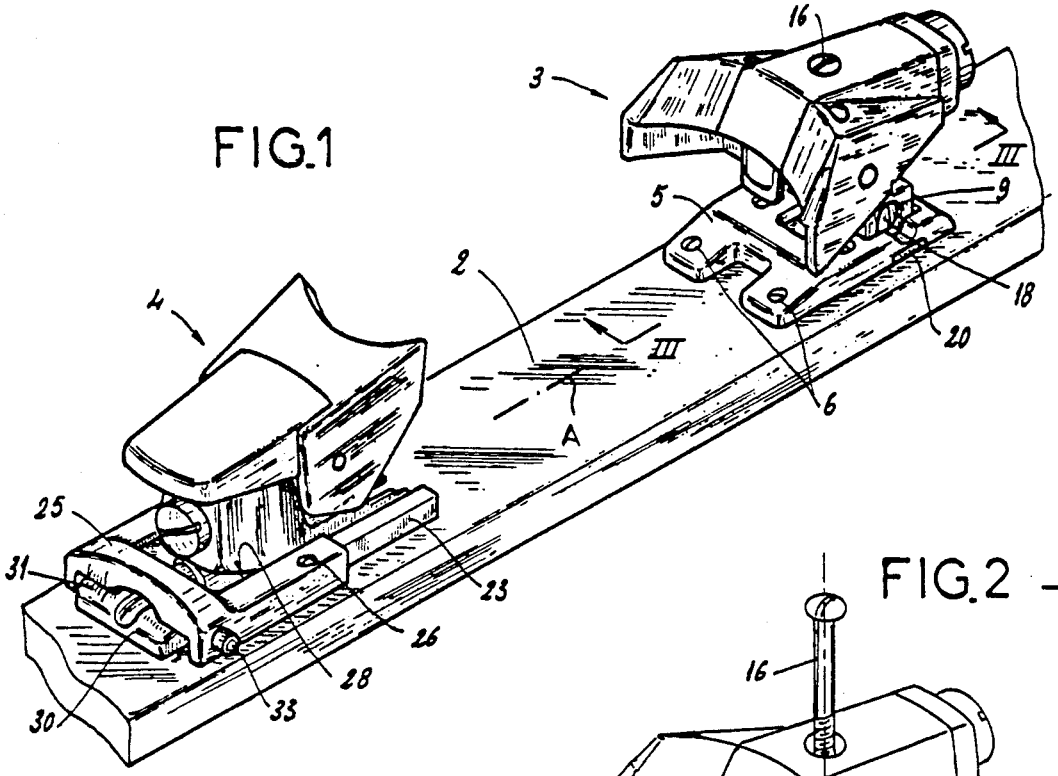
FIG. 1 is a perspective view of a ski binding secured to a ski with an adjustable mount according to this invention.

As seen in FIG. 1 a ski 2 has a centerline or longitudinal axis A and is provided with a front toe clamp 3 and a rear heel clamp 4 of conventional design, that is set up to release the respective parts of a ski boot when stressed beyond a predetermined limit for a predetermined time.

Figure 2:
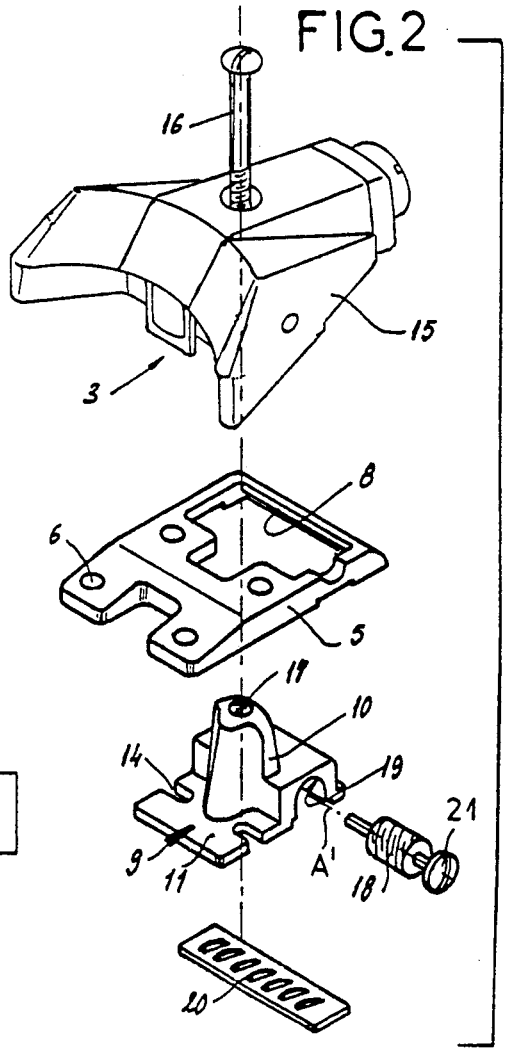
FIG. 2 is an exploded view of the toe part of the binding and mount.
Figure 4:
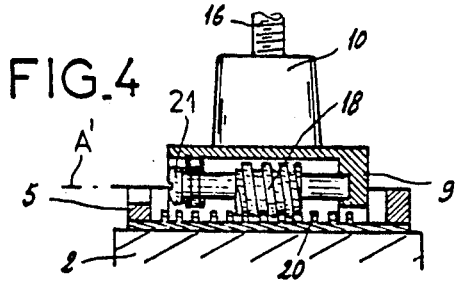
FIG. 4 is a cross section taken along line IV—IV of FIG. 3.
Figure 3:
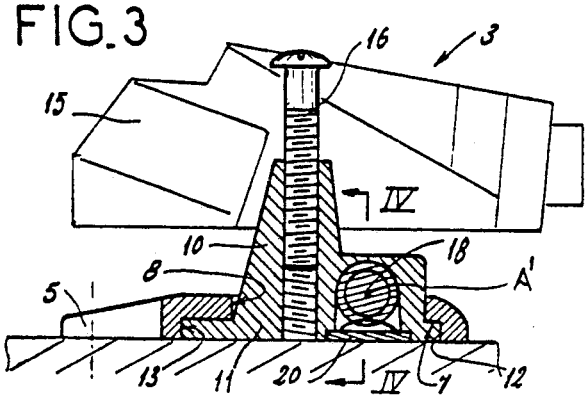
FIG. 3 is a longitudinal section taken along line III—III of FIG. 1.

In accordance with this invention as seen in FIGS. 2 through 4 the toe clamp 3 is carried on a front mounting plate 5 secured by screws passing through holes 6 to the ski 2 so as to be nondisplaceable thereon. This plate 5 is formed with a downwardly open pocket or seat 7 having front and rear edges 12 and 13 extending perpendicular to the axis A and is also formed with a throughgoing hole 8 opening upward above the seat 7. A front slide 9 is formed with an upstanding pivot 10 having a base 11 which is transversely substantially narrower than the transverse width of the hole 8 but whose front and rear edges can slide on the respective edges and 13 of the seat 7. In addition this base 11 is formed with laterally open notches 14 that allow the slide 9 to move transversely without being blocked by screws in the holes 6.

The toe clamp 3 has a body 15 that is secured to the pivot 10 by a screw 16 extending vertically perpendicular to the axis A and seated in a threaded bore 17 in this pivot 10. This construction is standard and can be seen, along with details of the toe clamp, in the above-cited patent documents.

The slide 9 is provided as best seen in FIGS. 2 through 4 with a micrometer-type worm screw 18 extending along an axis A′ extending perpendicular to and above the axis A of the ski 2, parallel to its upper surface. This worm 18 is blocked in the slide 9 against movement relative thereto along the axis A′ and has a head 21 accessible through a cutout 19 in one side of the slide 9. A rack 20 fixed to the ski 2 underneath the plate 5 and effectively integral with this plate 5 meshes with the worm 18.

Thus it is possible to displace the slide 9 and, with it, the front clamp 3 by engaging a tool in the head 21 and rotating the worm 18 about its axis A′. The mechanical advantage of the worm/rack connection is so considerable that it is impossible to bring enough force to bear on the clamp 3 to change the setting; it can only be changed by intentionally rotating the worm 18 which is held against free rotation by an unillustrated clip or spring.

Figure 5:
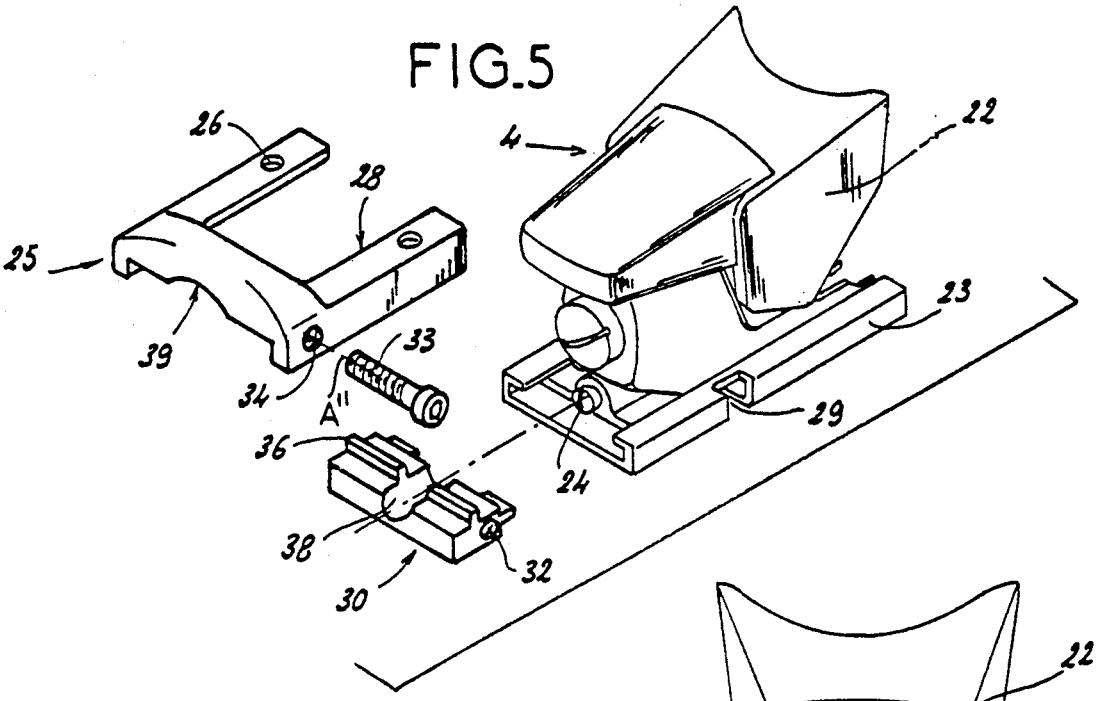
FIG. 5 is an exploded view of the heel part of the binding and mount.
Figure 7:
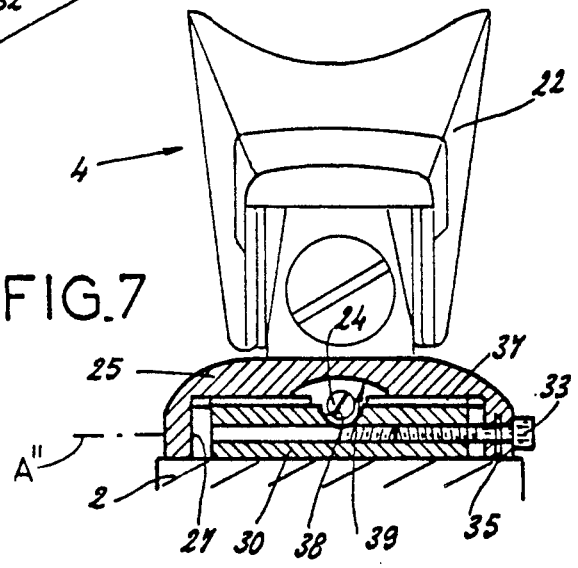
FIG. 7 is a cross section taken along line VII—VII of FIG. 6.
Figure 6:
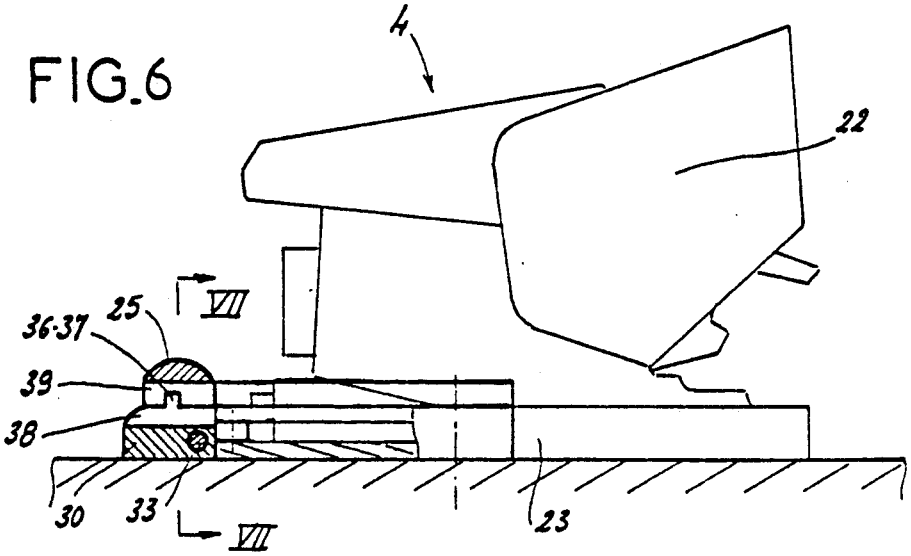
FIG. 6 is a side view partly in longitudinal section of the heel part and ski.

The heel clamp 4 as seen in FIGS. 5 through 7 has a body 22 which can be displaced longitudinally, that is parallel to the axis A, on a standard channel slide 23 by means of a screw 24 in the manner well known in the art to accommodate ski boots of different sizes. This channel 23 is in turn carried on a forwardly open U-shaped mounting plate 25 formed with holes 26 by means of which it is bolted to the top of the ski 2. This plate 25 in turn is formed with a downwardly open seat 27 and with an upwardly and forwardly open cutout 28 accommodating the channel 23 like the plate 5 accommodates the base 11 of the slide 9 of the toe clamp 3. Notches 29 in the slide 23 accommodate screws passing through the holes 26 like the notches 14 of the slide 9.

The rear end of the channel 23 is fixed to an abutment 30 formed with a threaded hole 32 extending along an axis A″ parallel to but rearward of the axis A′. A screw 33 passes through a hole 34 in the plate 25, is threaded into this hole 32 and is blocked by a pin or snap ring 35 against movement along the axis A″ relative to the plate 25. The upper side of the abutment 30 is formed with a ridge 36 extending parallel to the axis A″ and the seat 27 is formed with a complementary downwardly open groove 37 receiving this ridge 36 to keep these two parts aligned. In addition the abutment 30 and plate 25 are formed with respective cutouts 38 and 39 that give access to the screw 24. Scales or indicia 31 (see FIG. 1) are provided adjacent each other on the plate 25 and abutment 30 to allow the exact relative positions of these parts to be quantified.

It is therefore possible to adjust the lateral position of the heel clamp 4 by rotating the screw 33 which, like the worm 18, works with such a high mechanical advantage that once a position is set it remains set until the screw 33 is intentionally rotated. This system therefore allows the toe and heel clamps to be adjusted independently of each other, thereby allowing, if desired, the user's ski boot to be set at an angle to the axis A.

Figure 8:
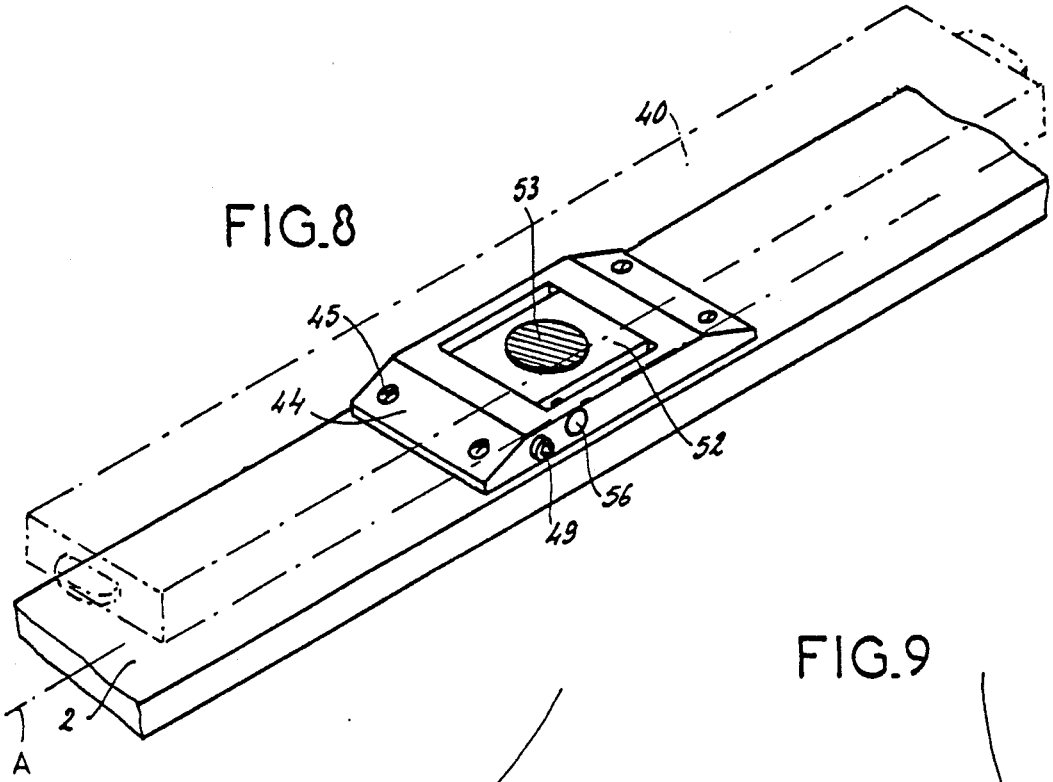
FIG. 8 is a perspective view of another mount according to this invention using a central mounting plate.
Figure 9:
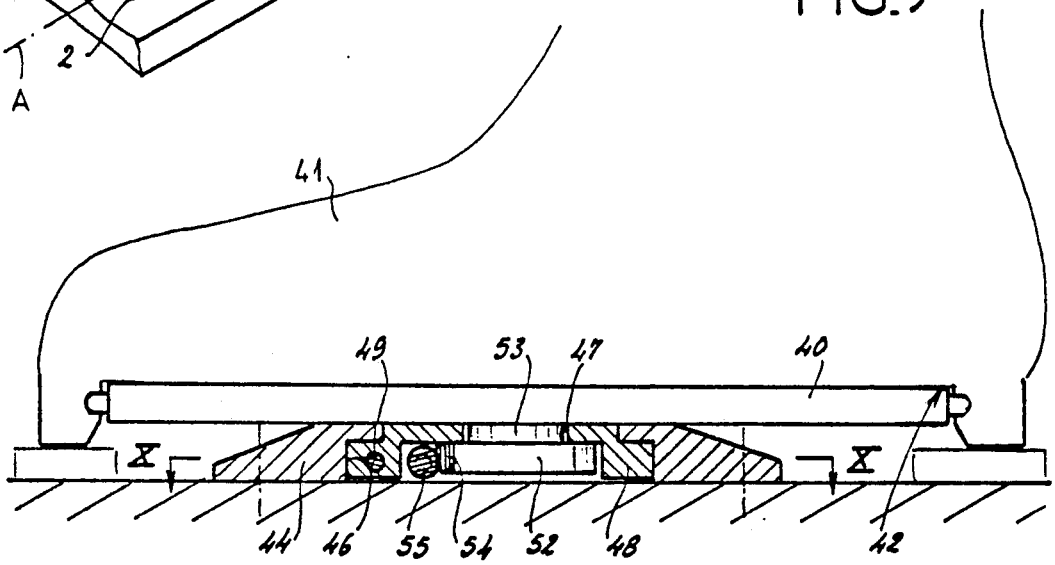
FIG. 9 is a longitudinal section through the center mount of FIG. 8.
Figure 10:
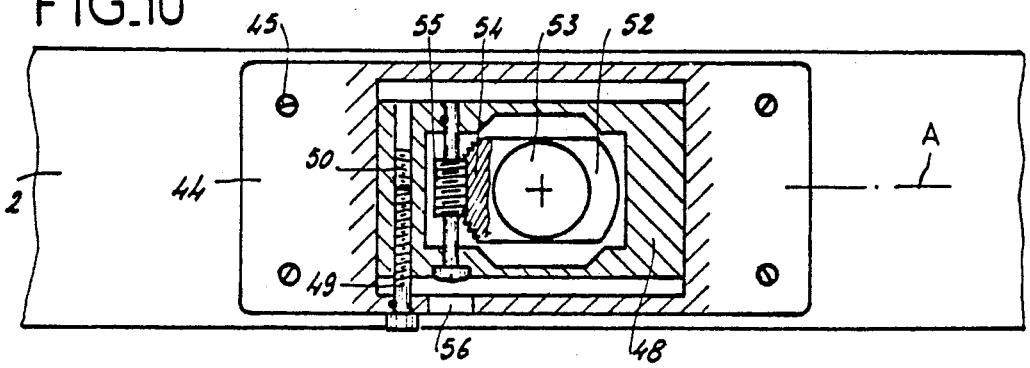
FIG. 10 is a horizontal longitudinal section taken along line X—X of FIG. 9.

The arrangement of FIGS. 8 through 10 is intended for use with a boot 41 formed with a downwardly open longitudinal slot 42 in which engages a releasable and longitudinally expandable bar 40. The mount comprises a plate 44 fixed via screw holes 45 to the top of the ski 2 and formed with a downwardly open seat 46 and an upwardly- open hole forming a seat 47 centered under the boot 41.

A slide 48 can move perpendicular to the ski axis A in the seat 47. A screw 49 fixed against transverse movement in the side of the plate 44 engages in a threaded bore 50 of the slide 48 to move it laterally like the worm 18 moves the slide 9 of FIGS. 2 through 4.

The boot-holding clip formed by the bar 40 is provided with a downwardly projecting post 53 that has a wheel 52 at its lower end formed with teeth 54 engaging with a worm 55 fixed in the slide 48 like the worm 18 is fixed in the slide 9. A lateral hole 56 in the plate 44 gives access to the head of the transversely extending screw or worm 55.

It is therefore possible to adjust the side-to-side position of the boot 41 by means of the screw 49 and to adjust the angle the boot 41 forms with the axis A by means of the worm 55.

I claim:

1. In combination with a ski having a longitudinally extending upper surface a ski boot having a toe and a heel, and respective toe and heel clamps engageable with the toe and heel for securing the boot to the upper surface, respective toe and heel mounts for each of the clamps, the mounts comprising:

respective toe and heel elements fixed to the ski;

respective toe and heel slide elements fixed to the respective clamps and displaceable transversely of the ski on the respective ski elements; and respective adjustment means each interconnecting the respective ski and clamp elements for relative stepless displacement transversely of the ski and for fixing the respective ski and clamp elements relative to each other against relative movement, the adjustment means of the toe clamp being steplessly adjustable independently of the adjustment means of the heel clamp, whereby the boot can be set at an angle to a longitudinal axis of the ski.

2. The ski boot mount defined in claim 1 wherein at least one of the adjusting means includes at least one micrometric screw rotatable but otherwise fixed in one of the respective elements and teeth formed on the other respective element and meshing with the respective screw.

3. The ski boot mount defined in claim 1 wherein the elements of each adjustment means are provided with adjacent indicia indicating their relative positions.

4. The ski boot mount defined in claim 1 wherein each ski element is a plate fixed generally centrally on the ski.

5. The ski boot mount defined in claim 4 wherein each ski element is formed with at least one guide surface extending generally perpendicular of the ski and the respective clamp element is a slide carried on the respective ski element, slidable along the guide surface thereof, and fixed to the respective clamp.

6. The ski boot mount defined in claim 5 wherein at least one of adjustment means includes a screw extending generally perpendicular of the ski, fixed transversely in one of the respective elements, and threadedly engaging the other respective element, whereby rotation of the screw relatively transversely displaces the respective elements.

7. The ski boot mount defined in claim 1 wherein the heel clamp is provided with a guide rail normally fixed on the ski, a clamp member displaceable longitudinally along the rail and engageable with the ski boot, and a screw for relatively longitudinally displacing the member and the rail, the respective ski element being secured to the rail.

8. The ski boot mount defined in claim 7 wherein the adjustment means includes a screw extending generally perpendicular of the ski, fixed transversely in one of the respective elements, and threadedly engaging the other respective element, whereby rotation of the screw relatively transversely displaces the respective elements.

9. The ski boot mount defined in claim 7 wherein the rail has an abutment and the ski element and the abutment are formed with an interfitting ridge and groove extending transversely of the ski.

10. The ski boot mount defined in claim 9 wherein the ski element of the heel clamp and abutment are formed with mutually vertically confronting and rearwardly open cutouts, the screw engaged between the member and rail being exposed at the cutouts, the cutout of the ski element being transversely wider than that of the abutment.

11. In combination with a ski having a longitudinally extending upper surface, a ski boot, and a boot element adapted for connection with the boot a mount comprising:

an element fixed to the ski;

a clamp element displaceable transversely of the ski on the ski element;

transverse adjustment means interconnecting the ski and clamp elements for relatively steplessly displacing the ski and clamp elements transversely of the ski and for fixing the ski and clamp elements relative to each other against relative transverse movement;

a post fixed to the boot element and projecting perpendicular to the upper surface into the clamp element; and angular adjustment means interconnecting the post and the clamp element for rotating the post and the ski boot about an axis perpendicular to the upper surface relative to the clamp and ski elements and for fixing the post and the clamp element against relative rotation, whereby the boot can be aligned at an angle to the ski longitudinal axis.

12. The ski boot mount defined in claim 11 wherein the angular adjustment means includes a screw fixed in the ski element and operatively engaged with the post.

13. The ski boot mount defined in claim 11 wherein the post is toothed and the angular adjustment means includes a worm meshing with the teeth of the post and extending tangentially thereof.

14. In combination:

a ski having a longitudinally extending upper surface;

a ski boot;

a heel clamp for securing the boot to the upper surface and provided with a guide rail normally fixed on the ski, a clamp member displaceable longitudinally along the rail and engageable with the ski boot, and a screw for relatively longitudinally displacing the clamp member and the rail, an abutment on the rail; and a mount including:

a ski element fixed to the rail;

an interfitting ridge and groove extending transversely of the ski and formed on the ski element and abutment;

an element fixed to the clamp member; and adjustment means interconnecting the elements for relative stepless displacement transversely of the ski and for fixing the ski and clamp elements relative to each other against relative movement.

* * * * *

UNITED STATES PATENT AND TRADEMARK OFFICE

CERTIFICATE OF CORRECTION

PATENT NO. : 5,118,128

DATED : 2 June 1992

INVENTOR(S) : Yves Piegay et al.

It is certified that error appears in the above-identified patent and that said Letters Patent is hereby corrected as shown below:

Title Page:

Item [73] should read:

--Assignee: Societe Anonyme Skis ROSSIGNOL S.A., Voiron, France-- .

Signed and Sealed this

Seventeenth Day of August, 1993

Bruce Lehman

*Attest:*

BRUCE LEHMAN

*Attesting Officer*

*Commissioner of Patents and Trademarks*